US006339688B1

(12) United States Patent
Cho et al.

(10) Patent No.: US 6,339,688 B1
(45) Date of Patent: Jan. 15, 2002

(54) AIR FILTERING APPARATUS OF LIQUID ELECTROPHOTOGRAPHIC PRINTER

(75) Inventors: Min-su Cho, Incheonkwangyeok; Ji-won Seo, Kunpo, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/604,982

(22) Filed: Jun. 28, 2000

(30) Foreign Application Priority Data

Oct. 2, 1999 (KR) ..... 99-42497

(51) Int. Cl.[7] ..... G03G 15/02
(52) U.S. Cl. ..... 399/93; 399/100
(58) Field of Search ..... 399/92, 93, 100, 399/115, 168, 170, 171, 172, 173

(56) References Cited

U.S. PATENT DOCUMENTS 4,264,184 A * 4/1981 Nishikawa et al. ..... 399/93
5,742,874 A * 4/1998 Koshimura et al. ..... 399/100

* cited by examiner

*Primary Examiner*—Sophia S. Chen
*Assistant Examiner*—Hoang Ngo
(74) *Attorney, Agent, or Firm*—Robert E. Bushnell, Esq.

(57) ABSTRACT

An air filtering apparatus of a liquid electrophotographic printer is mounted on a charger and includes a suction device sucking air in a main body of the printer and a filtering device filtering pollutants contained in the air sucked by the suction device. The suction device includes a discharge wire disposed adjacent to a photoreceptor web, a holder supporting the discharge wire located between the holder and the photoreceptor web and having one side facing the photoreceptor web, an opening formed in the other side of the holder, a cover coupled to the other side of the holder, a hollow portion formed inside of the cover, a slot formed on the cover and connecting the hollow portion to the opening, and an exhaust hole formed on one end of the hollow portion, and a suction pump connected to the exhaust hole and sucking air through the exhaust hole so that the air near the charger and the photoreceptor web can be exhausted through the opening of the holder, the slot and hollow position of the cover, and the exhaust hole. A plurality of filters are coupled to the suction pump. Pollutants such as ozone and solvent and carbon materials contained in the air are removed while the air is filtered by the filters and than exhausted outside of the main body of the printer.

37 Claims, 7 Drawing Sheets

AIR FILTERING APPARATUS OF LIQUID ELECTROPHOTOGRAPHIC PRINTER

CLAIM OF PRIORITY

This application makes reference to, incorporates the same herein, and claims all benefits accruing under 35 U.S.C. §119 from my application INNER AIR CLEANING APPARATUS FOR LIQUID ELECTROPHOTOGRAPHIC PRINTER filed with the Korean Industrial Property Office on Oct. 2, 1999 and there duly assigned Serial No. 42497/1999.

BACKGROUND OF THE INVENTION

1. Field of the Invention

The present invention relates to an air filtering apparatus in a liquid electrophotographic printer, and more particularly, an air filtering apparatus for effectively sucking air in the liquid electrophotographic printer and removing pollutants contained in the air.

2. Description of the Related Art

A liquid electrophotographic printer emits various types of pollutants, such as solvent and carbon materials and ozone, during a developing and printing process. The pollutants are generated from printing mechanisms and materials when a printable image is developed and printed on a sheet of paper by using the printing, materials in the developing and printing process. Air inside of the printer is contaminated with the pollutants which cause serious problems against both the printable image and the printing mechanisms. Moreover, the air containing the pollutants has a more harmful effects on human being if it is blown out of the printer.

The solvent evaporates during the developing process into the air inside of the printer and sticks to a laser scanner and a photoreceptor web bearing the printable image in the printer while the carbon material is generated during drying the printable image formed on the photoreceptor web and transferring the printable image from the photoreceptor web to the sheet of paper in the developing and printing process. The ozone is generated from a plurality of chargers disposed adjacent to the photoreceptor web during initializing and changing the photoreceptor web with a high voltage.

Most of the pollutants are not effectively removed in a conventional printer. Although a filtering apparatus is installed in the printer to eliminate the solvent contained in the air, neither the structure of a duct of the filtering apparatus nor the location of the duct installed inside of the printer is enough to filter the air containing the pollutants. Since the air containing the pollutants is not efficiently sucked into the duct, the pollutants can not be properly removed from the printer. Therefore, a life span of the printer is shortened, and the quality of the printed image becomes deteriorated.

SUMMARY OF THE INVENTION

It is an object of the present invention to provide a filtering apparatus able to protect mechanical parts and maintain the quality of a printed image.

It is another object to provide a filtering apparatus in a printer able to effectively remove pollutants contained in air inside of the printer.

It is yet another object to provide a filtering apparatus able to filter air containing pollutants generated from printing materials used in a printer.

It is still another object to provide a filter apparatus able to uniformly suck air near a charger, developing unit, and a photoreceptor web in a printer.

It is a further object to provide a filtering apparatus suitable for use with a charger initializing or charging a photoreceptor web during a developing and printing process.

It is also an object to provide a filtering apparatus having a duct able to be mounted on a charger initializing or charging a photoreceptor web in a printer.

These and other objects may be achieved by providing a liquid electrophotographic printer with a filtering apparatus including a charger having a discharge wire charging a photoreceptor web to a predetermined level of electric potential, a laser scanner forming an electrostatic latent image on the charged photoreceptor web, a development unit developing the electrostatic latent image to a printable image, a transfer unit printing the printable image on a sheet of paper, a suction device having a duct mounted on the charger and sucking air in the printer, and a filtering device filtering pollutants contained in the air sucked by the suction device.

The suction device of the air filtering apparatus includes a discharge wire connected to a voltage source, a holder supporting the discharge wire, a grid net attached to one side of the holder and facing the photoreceptor web, a plurality of openings formed on the holder, a cover coupled to the other side of the holder, a hollow portion formed inside of the cover, a slot formed on the cover and connecting the openings to the hollow portion, an exhaust hole connected to one end of the hollow portion, and a suction pump connected to the exhaust hole and sucking air inside of the printer through the openings, the slot, the exhaust hole, and the exhaust hole.

The slot varies in width from one end to the other end of the slot. The width of the slot disposed remote from the exhaust hole is greater than the slot disposed adjacent to the exhaust hole. The width of the slot increases from one end of the slot to the other end of the slot.

The suction device includes a discharge wire connected to a voltage source, a shield plate accommodating the discharge wire, a plurality of slots formed on the shield plate, a holder attached to the shield plate, a passage formed between the shield plate and the holder, and an exhaust hole formed on one end of the passage. Air around the discharge wire is sucked through the slots, the passage, and the exhaust hole.

The suction device is mounted on a main charger initializing the photoreceptor web. A plurality of suction devices mounted on each corresponding charger charging the photoreceptor web are disposed adjacent to each corresponding development unit. Each exhaust hole of the suction devices is connected to a shared pipe. The suction pump is connected to the shared pipe. A plurality of filters suitable to filter pollutants such as solvent and carbon materials and ozone are connected to the suction pump.

The suction devices disposed adjacent to the transfer unit includes a main duct having two branch ducts disposed adjacent to both sides of the transfer unit and slots formed on the branch ducts. An exhaust hole is formed on one end of the main duct and coupled to a suction pump. A plurality of filters are connected to the suction pump in order to remove pollutants contained in the air inside of the printer.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
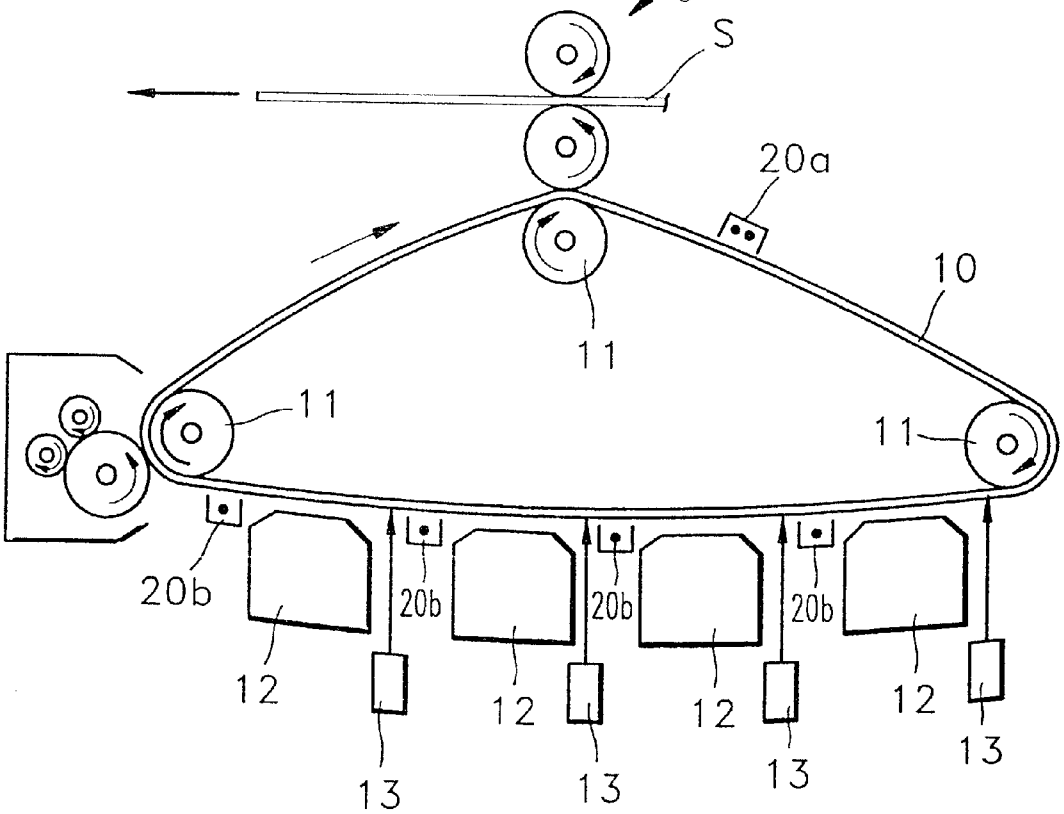
FIG. 1 (PRIOR ART)
FIG. 1 is a schematic diagram of major elements of conventional liquid electrophotographic printer.

FIG. 1 shows a conventional liquid electrophotographic printer such as a typical color laser printer. A photoreceptor web 10 circulates around a plurality of rollers 11 while being supported by rollers 11. An electrostatic latent image is formed by a laser scanner 13 on photoreceptor web 10. The electrostatic latent image is developed by a development unit 12, and a printable image of a predetermined color is formed on photoreceptor web 10. The developed printable image is printed on a sheet of paper S by a transfer unit 14.

Development unit 12 uses a developer, which is a mixture of toner powder and a liquid solvent, in developing the electrostatic latent image. The solvent evaporates during a developing process at the development unit 12 and a transferring process at the transfer unit 14, and the evaporated solvent remains in air inside of the printer. When the amount of the evaporated solvent increases, the evaporated solvent sticks to photoreceptor web 10 or laser scanner 13 and cause a serious problem in forming and developing the electrostatic latent image on photoreceptor web 10 and printing the printable image on the paper S.

Figure 2:
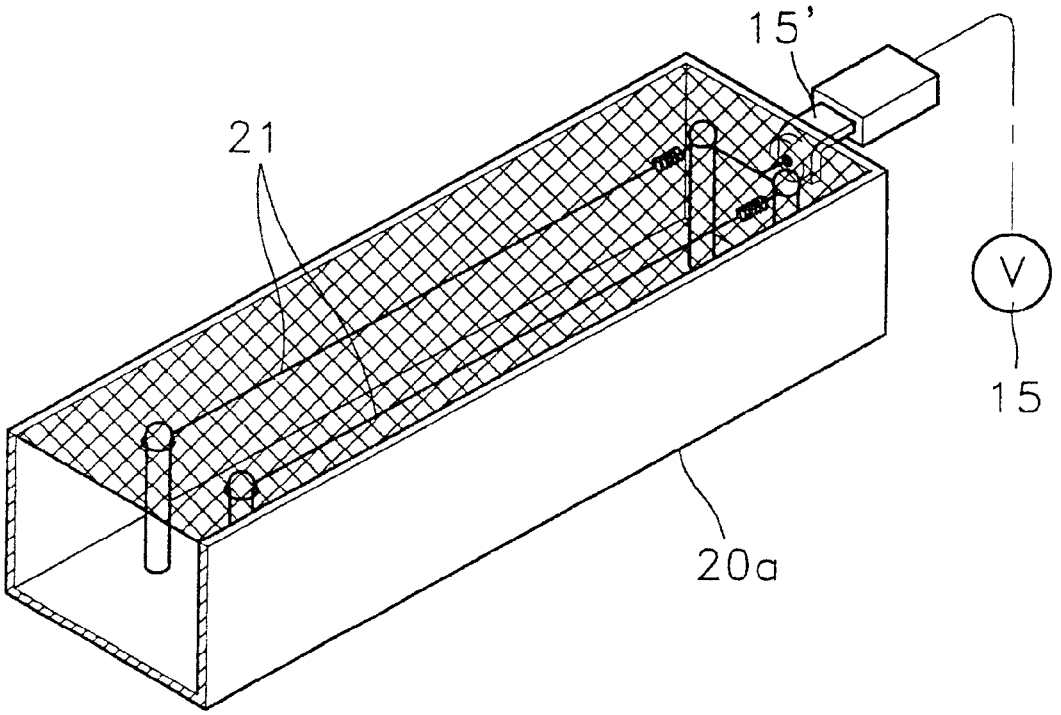
FIG. 2 (PRIOR ART)
FIG. 2 is a perspective view showing a main charger shown in FIG. 1.

A charger charges a surface of photoreceptor web 10 to predetermined electric potential so that the electrostatic latent image can be formed on photoreceptor web 10. The charger includes a main charger 20*a* performing initialization by charging photoreceptor web 10 after an printable image has been printed on a sheet of paper S and a topping charger 20*b* charging photoreceptor web 10. An electrostatic latent image is formed on photoreceptor web 10 whenever photoreceptor web 10 passes each development unit 12. The operating principles of these two chargers are same. For example, the main charger 20*a* has discharge wires 21 discharging photoreceptor web 10 when a voltage is supplied from a power source 15 to discharge wires 21 through an electrode 15', as shown in FIG. 2. Photoreceptor web 10 is charged to a predetermined voltage by a corona discharge of the discharge wires 21. Photoreceptor web 10 must be charged to about 600 volts while discharge wires 21 themselves discharge a very high voltage reaching an instantaneous voltage of several thousand volts. Some oxygens ($O_2$) near the charger are changed to ozone ($O_3$) due to the high voltage. Ozone has strong bleaching and oxidizing capabilities so that life span of elements, such as a photoreceptor web, a developing unit, and a transferring unit, in the printer may be shortened when the amount of ozone increases with repeated use of the printer.

Figure 3A:
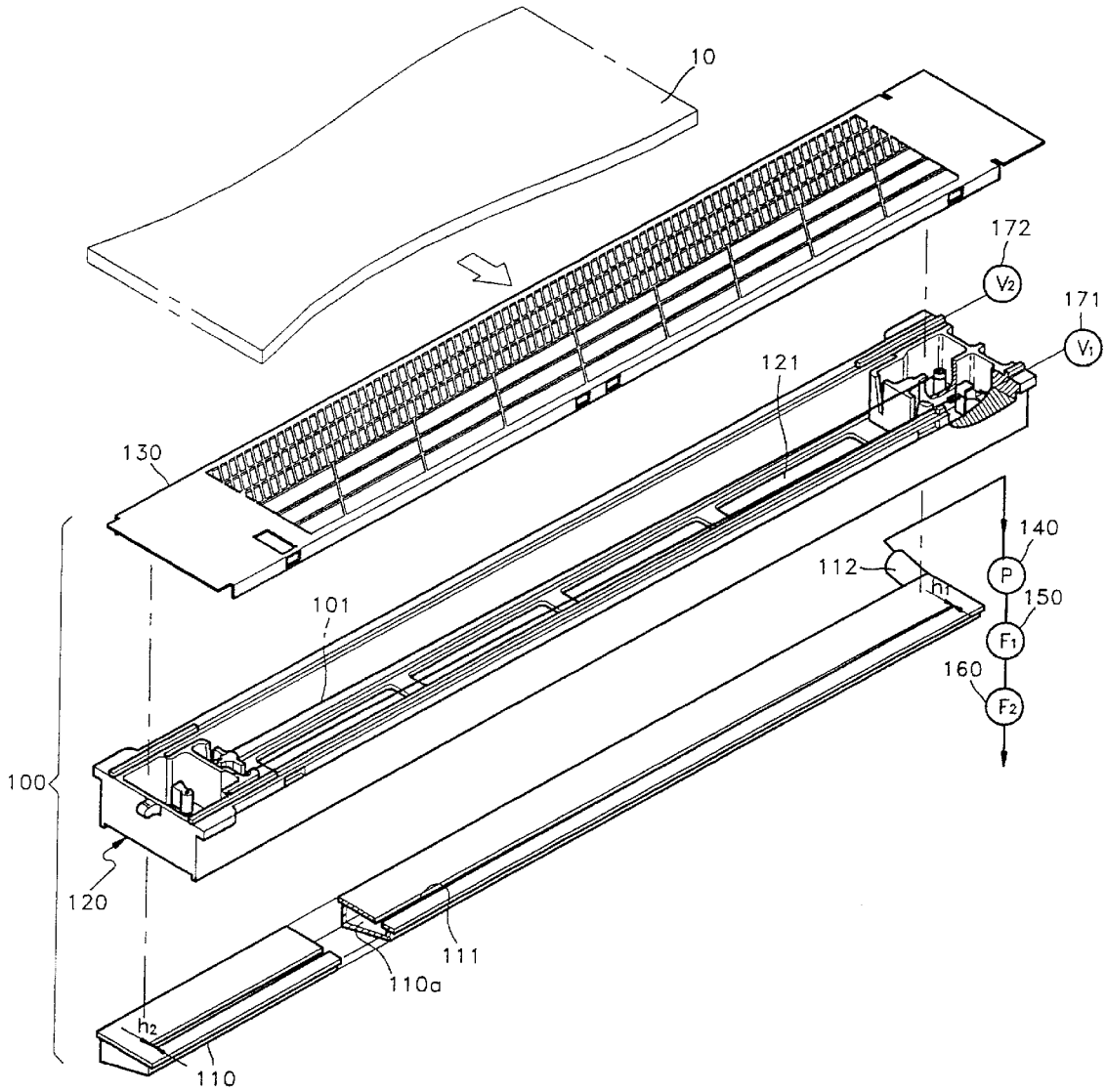
FIGS. 3A and 3B are an exploded perspective view and a cross-sectional view showing an air filtering apparatus according to the principle of the present invention, respectively.
Figure 3B:
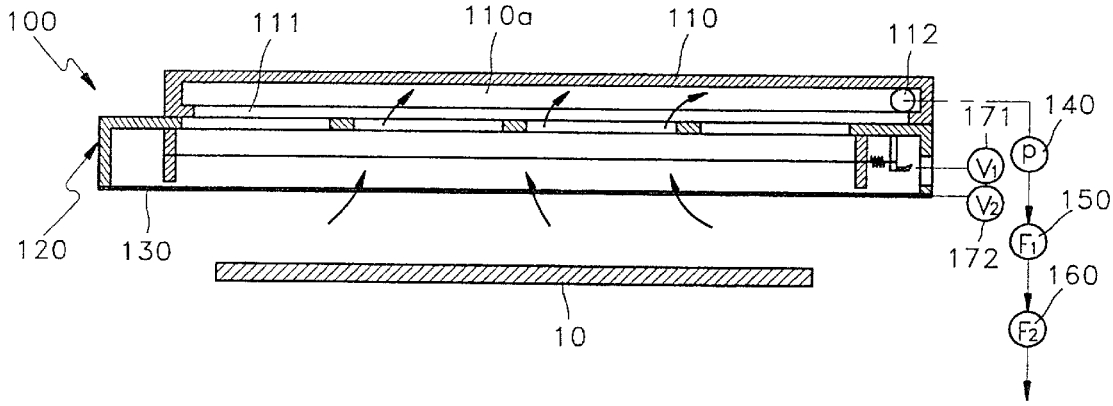

Returning now to FIGS. 3A and 3B, an air filtering apparatus of a liquid electrophotographic printer is mounted on a main charger 100 charging and initializing a photoreceptor web 10. Although the air filter apparatus mounted on main charger 100 is used for mainly removing the ozone generated from main charger 100, both ozone generated at a topping charger and solvent and carbon materials generated from a developing unit and a transferring unit are removed by the filtering apparatus mounted on main charger 100.

A holder 120 contains and supports a discharge wire 101. A first electric power $V_1$ 171 coupled to discharge wire 101 applies a voltage of 6–7 kV to discharge wire 101. An upper portion of holder 120 is open to photoreceptor web 10 and covered by a grid net 130. A plurality of openings 121 such as slits are formed on bottom portion of holder 120. Grid net 130 is installed to control an electric potential charged to 600–700 V by a second electric power $V_2$ 172 which is independent of the first electric power $V_1$ 171. This arrangement is for achieving a state of balance between photoreceptor web 10 and grid net 130 after photoreceptor web 10 is charged to 600–700 V which is the electric potential charged to grid net 130. The electric potential of photoreceptor web 10 can be adjusted by adjusting the electric potential of gridnet 130. An upper surface of holder 120 made of metal contacts one side of grid net 130 so that the second electric power 172 and the grid net 130 can be electrically connected.

A cover 110 is coupled to a bottom of holder 120 where the openings 121 are formed. A hollow portion 110*a* is formed inside of the cover 110 and, a slot 111 is formed on cover 110 and couples hollow portion 110*a* to openings 121. An exhaust hole 112 are formed on one end of hollow portion 110*a*. Thus, air around photoreceptor web 10 is exhausted to exhaust hole 112 through an exhaust path including grid net 130, openings of holder 120, and slot 111 and hollow portion 110*a* of cover 110. A suction pump 140 is connected to the exhaust hole 112 of cover 110. When the suction pump 140 operates, air near main charger 100 and photoreceptor web 10 passes through grid net 130 and is sucked through openings 121 of holder 120 and slot 111 of cover 110. Then, the sucked air is blown along hollow portion 110*a* and is exhausted through exhaust hole 112.

A platinum catalyst filter 150 and a carbon filter 160 as a filtering device are installed along the exhaust path and connected to suction pump 140. The filtering device filters out pollutants from the sucked air. The platinum catalyst filter 150 decomposes the ozone contained in the air utilizing the principle that the decomposition of ozone is expedited as it acts on platinum, lead oxide, manganese oxide or copper oxide. The carbon filter 160 is a filter having superior absorbing capability like active carbon and is installed to collect a solvent contained in the air. As a result, while passing through the filters, the ozone and the solvent are filtered, and filtered air is exhausted to an outside of the printer. Therefore, after the air inside of the printer is sucked to be filtered, and ozone and solvent are removed from the sucked air, the air inside the printer is exhausted to the outside of the printer or returned to the inside of the printer.

The width h1 of slot 111 at the side of the exhaust hole 112 is about 0.5 mm, and slot 111 becomes wider to about 2.0 mm at the position of width h2 of slot 11 . This is to compensate for the difference in the amount of sucked air by suction pump 140 through slot 111 because suction power at the position near exhaust hole 112 is greater than at the opposite side remote from exhaust hole 112. The air is uniformly sucked through the entire length of slot 111 . Thus, when suction pump 140 operates, a nearly same amount of air along the entire length of the slot 111 is sucked from slot 111 and exhausted through exhaust hole 112.

Figure 4A:
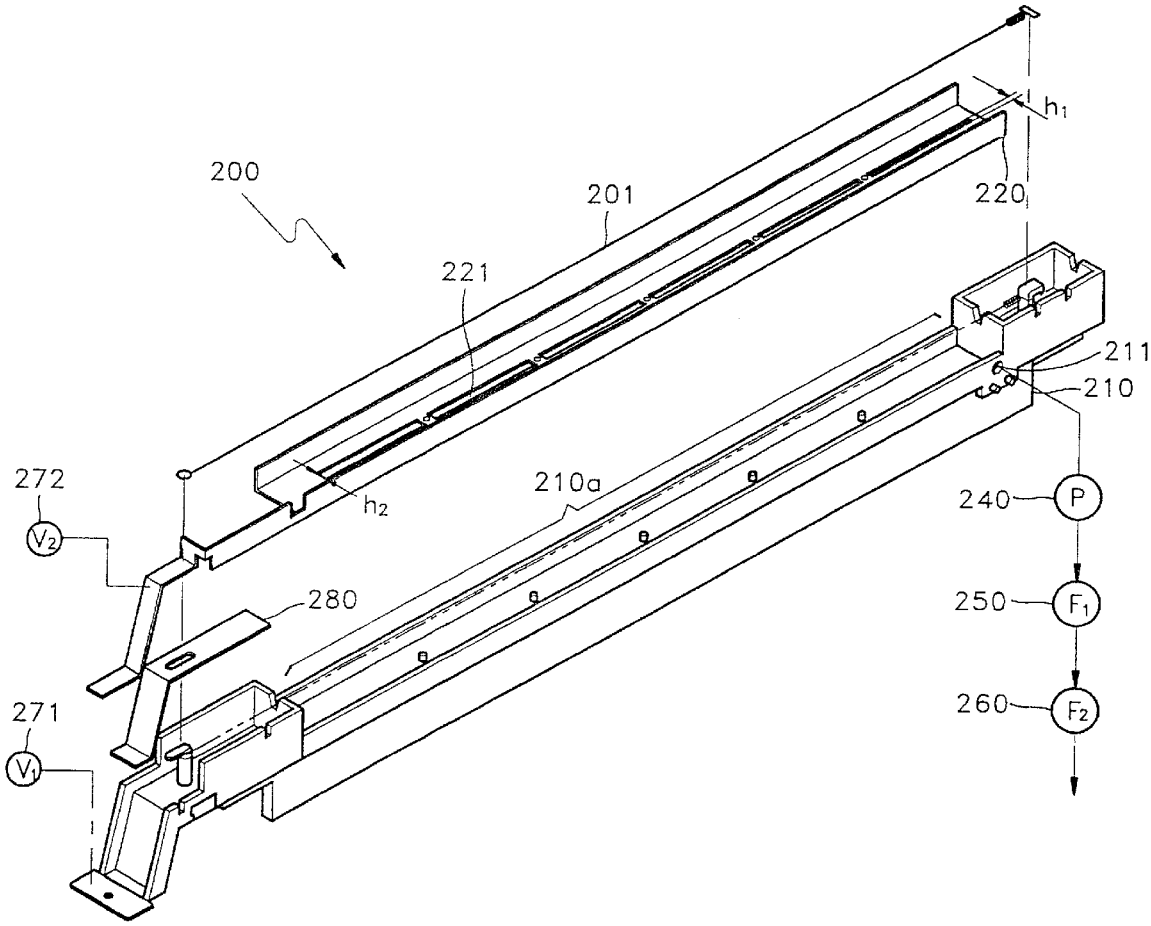
FIGS. 4A and 4*b* are an exploded perspective view and a cross-sectional view showing an air filtering apparatus according to a second embodiment of the present invention, respectively.
Figure 4B:
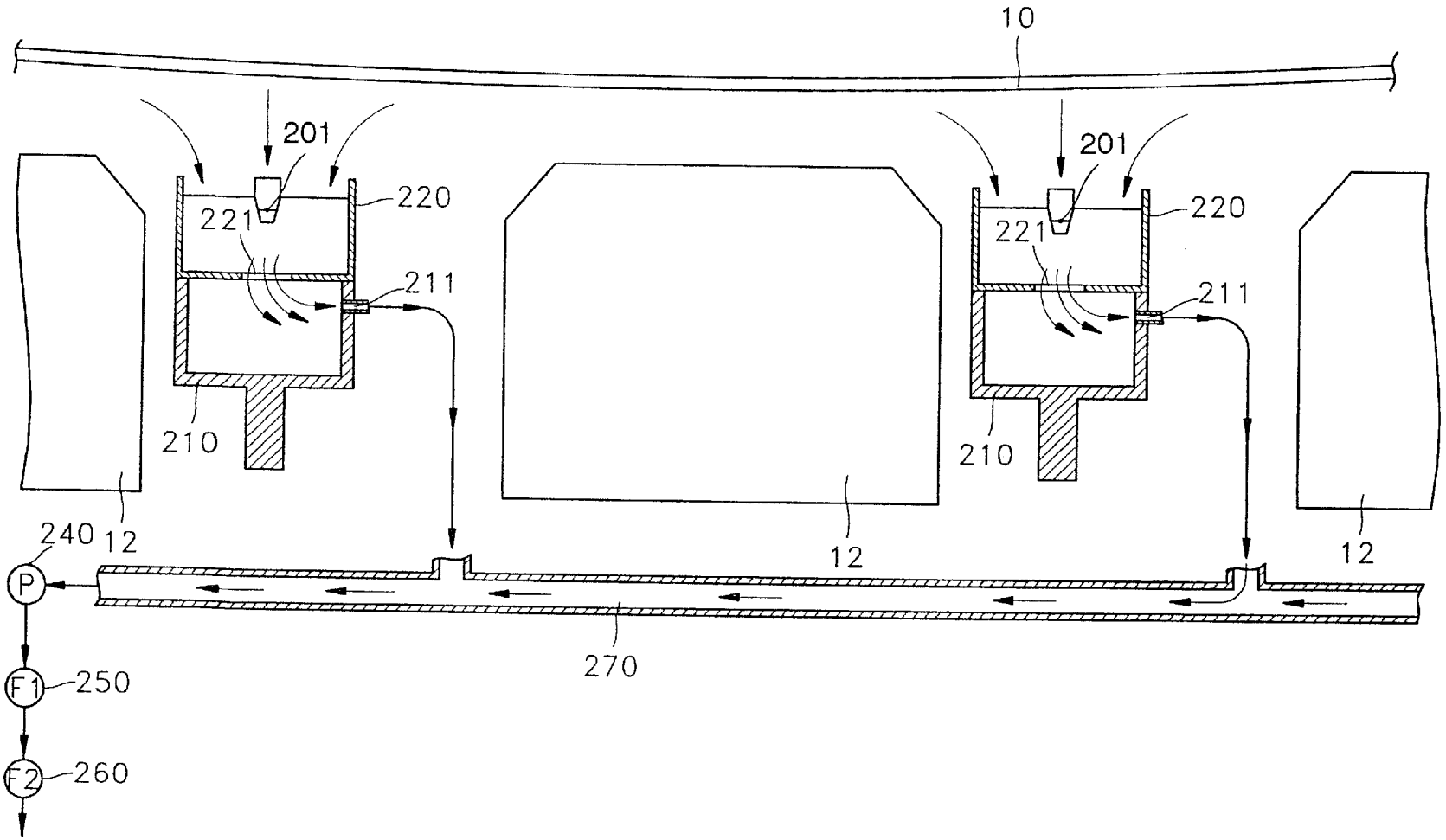

FIGS. 4A and 4B show an air filtering apparatus mounted on a topping charger 200 mainly used for removing ozone generated from topping charger 200 while the ozone generated from main charger 100 and the solvent and carbon materials generated from development unit 12 and transfer unit 14 are also removed by the air filter mounted on topping, charger 200. A holder 210 supports a discharge wire 201 of topping charger 200, and a shield plate 220 is coupled to holder 210 and disposed between holder 210 and discharger wire 200. A slot 221 is formed lengthwise on shield plate 220. When holder 210 is coupled to shield plate 220, a path 210*a* is formed between holder 210 and shield plate 220 and connected to slot 221.

An exhaust hole 211 is formed at one end of holder 210 and connected to a shared pipe 270 connected to a suction pump 240. Shared pipe 270 is connected between suction pump 240 and each exhaust hole 211 so that an exhaust path coupled to one suction pump 240 is shared with the adjacent suction device mounted on each topping charger 200 as shown in FIG. 4B. A platinum catalyst filter 250 and a carbon filter 260 are coupled to suction pump 240. Reference numeral 271 denotes a first electric power for applying a first voltage to discharge wire 201. Reference numeral 272 denotes a second electric power for applying a second voltage to shield case 220 performing a function of controlling the electric potential discharged from discharge wire 201 to photoreceptor web 10 like the grid net 130 of FIG. 3A. Reference numeral 280 denotes an insulator.

When suction pump 240 operates, air near topping charger 200 is sucked through slot 221 of shield plate 220, path 210*a* and exhaust hole 211, and then exhausted through shared pipe 270. After platinum catalyst filter 250 and carbon filter 260 filter the ozone and the solvent and carbon materials, the filtered air is exhausted. The shape of slot 221 is formed to be narrower at a position near exhaust hole 211 and wider at an opposite side remote from exhaust hole 211.

Figure 5:
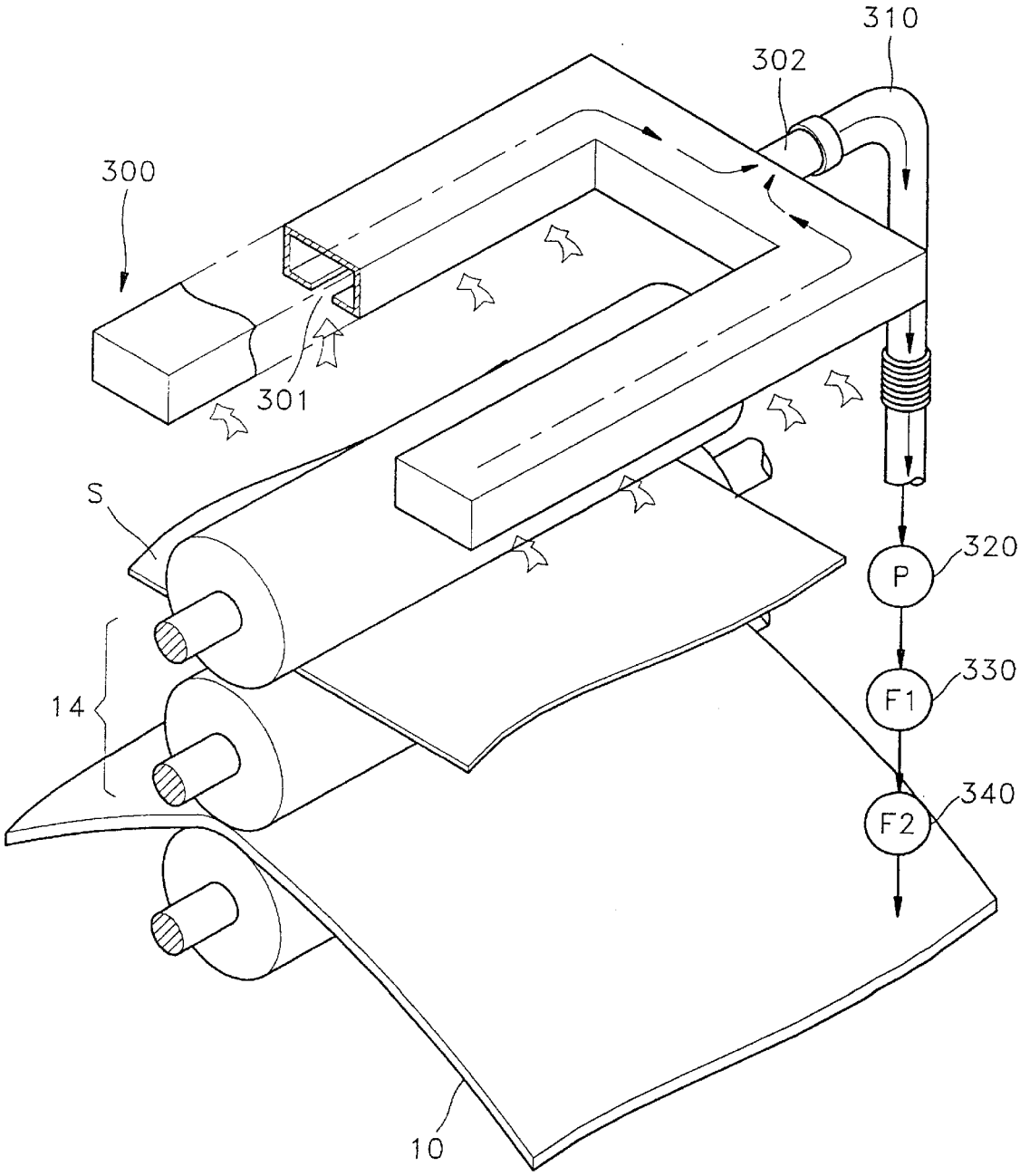
FIG. 5 is a partially exploded perspective view showing an air filtering apparatus according to a third embodiment of the present invention.

FIG. 5 shows an air filtering apparatus mounted adjacent to transfer unit 14 transferring the printable image from photoreceptor web 10 to a sheet of paper S. Although the solvent and carbon materials generated from transfer unit 14 is mainly removed by the air filtering apparatus mounted adjacent to transfer unit 14, the other pollutants generated from the main charger and the topping charger can be removed. A main duct 300 is disposed adjacent to and above transfer unit 14. A slot 301 like an inlet is formed on a bottom of main duct 300 and is facing transfer unit 14. Two branch ducts of main duct 300 are disposed on both sides of transfer unit as shown in FIG. 5. Each one end of the two branches meets at an exhaust hole 302. A connection pipe 310 is connected to exhaust hole 302 of main duct 300 so that air surrounding transfer unit 14 can be sucked through two branch ducts of main duct 300, exhaust hole 302, and connection pipe 310 into a suction pump 320. Pollutants contained in the air sucked by suction pump 320 is removed by a platinum catalyst filter 330 and a carbon filter 340.

When suction pump 320 operates, the air near the transfer unit 14 is sucked through slot 301 of duct 300. The air passes through platinum catalyst filter 330 and carbon filter 340 via connection pipe 310 of exhaust hole 302. While the air passes through platinum catalyst filter 330 and carbon filter 340, the ozone and the solvent are filtered, and the filtered air is exhausted to the outside of the printer or returned to the inside of the printer. Slot 301 is formed to be narrower at the position near exhaust hole 302 while Slot 301 is formed to be wider at the opposite side remote from exhaust hole 302.

As described above, in the air filtering apparatus of a liquid electrophotographic printer according to the present invention, the air filtering apparatus mounted on either a main charger initializing the photoreceptor web or a top charger charging the photoreceptor web or adjacent to a transfer unit transferring a printable image from the photoreceptor web to a sheet of paper filters air inside of the printer and removes from the air pollutants such as ozone generated from main and top chargers and the solvent and carbon materials generated from a developing unit. Since the filtered air is exhausted, environmental and pollution problems can be reduced, and harmful effects on printing mechanisms by repeated use of the printer can be removed. Therefore, life spans of mechanisms in the printer may be extended, and the quality of the printable image can be maintained.

What is claimed is:

1. An air filtering apparatus in a printer, comprising:

a charger having a wire applying electric potential to a photoreceptor web;

a holder supporting said charger, having a grid disposed between said charger and said photoreceptor web, and having an opening disposed adjacent to said charger opposite to said grid;

a longitudinal hollow duct having a longitudinal side disposed adjacent to said opening of said holder, having a longitudinal passage formed inside said duct along said longitudinal side;

a longitudinal slot formed on said longitudinal side of said duct along said wire in a longitudinal direction and disposed between said opening and said longitudinal passage;

an exhaust hole formed on one end wall of said longitudinal side of said duct and communicated with said longitudinal passage;

a pump connected to said exhaust hole, sucking air inside of said holder through said opening, said slot, said longitudinal passage and said exhaust hole in sequence, said pump discharging the air outside said duct through a pipe coupled to said pump; and a filter connected to said pipe, filtering the air and removing pollutants contained in the air.

2. The air filtering apparatus of claim 1, said filter including either a platinum catalyst filter or a carbon filter.

3. The air filtering apparatus of claim 1, further comprising a plurality of slots formed on said longitudinal side of said duct in a line, each of said slots linearly varying in width along said longitudinal direction.

4. The air filtering apparatus of claim 3, with each of said slots having one end wider than the other end of said slot.

5. The air filtering apparatus of claim 3, wherein the smallest width of one of said slots being greater than the greatest width of the other slot disposed adjacent to said one of said slots.

6. The air filtering apparatus of claim 3, further comprising a plurality of openings formed on said holder, disposed to correspond to each one of said slots.

7. The air filtering apparatus of claim 1, with said an exhaust hole disposed on said one end of said longitudinal passage and connecting longitudinal passage to said pump.

8. The air filtering apparatus of claim 7, wherein the width of said slot adjacent to said exhaust hole is less than the width of said slot disposed another end of said longitudinal passage opposite to said exhaust hole.

9. The air filtering apparatus of claim 1, said slot gradually varying in width in said longitudinal direction.

10. The air filtering apparatus of claim 1, said slot being gradually wider from one end to the other end in said longitudinal direction.

11. An air filtering apparatus in a printer, comprising:

a plurality of chargers each having a wire charging a photoreceptor web, each disposed adjacent to a corresponding developing unit developing an image on said photoreceptor web;

a plurality of holders each supporting each corresponding charger, each having a longitudinal hallow duct attached to said longitudinal shield member opposite to said photoreceptor web, each having a longitudinal plate disposed between said longitudinal hollow duct and said longitudinal shield member, said longitudinal plate having a slot formed in a longitudinal direction;

a longitudinal passage formed inside said longitudinal hollow duct communicated with said slot;

an exhaust hole formed on a side of said longitudinal hollow duct and disposed on one end portion of said longitudinal passage;

a shared pipe having a plurality of inlets each connected to each exhaust hole of said holders;

a pump connected to one outlet of said shared pipe, sucking air inside of said charger through said slot and said longitudinal passage; and a filter connected to said pump, filtering the air and removing pollutants contained in the air.

12. The air filtering apparatus of claim 11, further comprising a plurality of slots formed on said longitudinal plate in line, each of said slots varying in width in said longitudinal direction.

13. The air filtering apparatus of claim 12, with each of said slots having one end wider than the other end of said slot.

14. The air filtering apparatus of claim 12, wherein the smallest width of one of said slots being greater than the other slot disposed adjacent to said one of said slots.

15. The air filtering apparatus of claim 11, wherein the width of said slot adjacent to said exhaust hole is less than the width of said slot disposed another end of said longitudinal passage opposite to said exhaust hole.

16. The air filtering apparatus of claim 11, said slot varying in width in said longitudinal direction.

17. The air filtering apparatus of claim 11, said slot being gradually wider from one end to the other end in said longitudinal direction.

18. An air filtering apparatus in a printer, comprising:

a charger having a wire charging a photoreceptor web;

a holder having a longitudinal shield member supporting said charger, having a longitudinal hollow duct attached to said longitudinal shield member opposite to said photoreceptor web, having a longitudinal plate disposed between said duct and said shield member, said longitudinal plate having a slot formed along said wire in a longitudinal direction, said slot varying in width in said longitudinal direction;

a longitudinal passage formed inside said longitudinal hollow duct along said longitudinal direction;

an exhaust hole formed on one end portion of said longitudinal passage;

a pipe connected to said exhaust hole; and a pump connected to said pipe, sucking air inside of said charger through said slot and said longitudinal passage.

19. The air filtering apparatus of claim 18, further comprising a filter connected to said pump and including either a platinum catalyst filter or a carbon filter.

20. The air filtering apparatus of claim 18, said slot varying in width in said longitudinal direction and having one end wider than the other end of said slot.

21. The air filtering apparatus of claim 18, further comprising a plurality of slots formed on said longitudinal plate along said longitudinal direction in line, each of said slots varying in width in said longitudinal direction and having one end wider than the other end of said slot, wherein the smallest width of one slot is greater than the greatest width of other slot disposed adjacent to said one slot.

22. The air filtering apparatus of claim 18, wherein one end of said slot is greater in width than the other opposite end of said slot adjacent to said exhaust hole.

23. An air filtering apparatus in a printer having a printing mechanism, comprising:

a duct disposed adjacent to said printing mechanism, having a longitudinal slot formed on a surface of said duct in a longitudinal direction, and having a longitudinal passage formed inside said duct in said longitudinal direction, said longitudinal slot varying in width along said longitudinal direction;

a pump connected to one end of said longitudinal passage, sucking, air around said printing mechanism of said printer through said longitudinal slot and said longitudinal passage; and a filter connected to said pump, filtering the air and removing pollutants contained in the air.

24. The air filtering apparatus of claim 23, said duct having an exhaust hole formed on one end portion of said longitudinal passage and coupled to said pump, said duct having a pair of branch ducts disposed both sides of said printing mechanism, said duct having a common duct connected to said branch ducts and said exhaust hole.

25. The air filtering apparatus of claim 24, said slot formed on each of said branch ducts, said duct having one end remote from said exhaust hole wider than the other opposite end of said slot adjacent to said exhaust hole.

26. An air filtering apparatus in a printer, comprising:

a charger having a wire charging a photoreceptor web to predetermined electric potential;

a suction device attached to said charger, having a passage formed inside said suction device, and having a slot formed on a surface of said suction device along said wire in a longitudinal direction, said slot communicated with said passage and said charger, said suction device having an exhaust hole formed on end portion of said passage of said duct; and a pump device connected to said exhaust hole, sucking air near said charger through said slot and said passage.

27. The air filtering apparatus of claim 26, further comprising a filtering device coupled to said pump, including either a platinum catalyst filter or a carbon filter.

28. The air filtering apparatus of claim 26, wherein one end of said slot adjacent to an inlet of said pump is narrower than the other end of said slot remote from said inlet of said pump.

29. The air filtering apparatus of claim 1, with said duct having said longitudinal passage gradually varying in area parallel to said longitudinal direction.

30. The air filtering apparatus of claim 29, with said slit gradually varying in width in said longitudinal direction.

31. The air filtering apparatus of claim 1, with said slit linearly varying in width in said longitudinal direction.

32. The air filtering apparatus of claim 11, with said duct having said longitudinal passage varying in area in a direction parallel to said longitudinal direction.

33. The air filtering apparatus of claim 32, with said slit varying in width in said longitudinal direction.

34. The air filtering apparatus of claim 18, with said duct having said longitudinal passage varying in area along a direction parallel to said longitudinal direction.

35. The air filtering apparatus of claim 34, with said slot varying in width along said longitudinal direction.

36. The air filtering apparatus of claim 23, with said duct having said longitudinal passage varying in area along a direction parallel to said longitudinal direction.

37. The air filtering apparatus of claim 26, with said passage varying in area along a direction parallel to said longitudinal direction.

* * * * *